US006935884B1

(12) United States Patent
Perkin

(10) Patent No.: US 6,935,884 B1
(45) Date of Patent: Aug. 30, 2005

(54) ELECTRICAL CONNECTOR

(76) Inventor: Richard J. H. Perkin, 32 Kenmain Gardens-10 Main Rd., Kenilworth, Cape Town 7008 (ZA)

( * ) Notice: Subject to any disclaimer, the term of this patent is extended or adjusted under 35 U.S.C. 154(b) by 404 days.

(21) Appl. No.: 10/185,688

(22) Filed: Jun. 28, 2002

(51) Int. Cl.[7] ..... H01R 4/24
(52) U.S. Cl. ..... 439/409; 439/460; 439/696
(58) Field of Search ..... 439/409, 460, 439/463, 465, 687, 696, 697, 731, 942, 953

(56) References Cited

U.S. PATENT DOCUMENTS

| | | | | |
|---|---|---|---|---|
| 3,596,232 A | | 7/1971 | Medley | |
| 4,414,427 A | * | 11/1983 | Slater et al. | 174/65 R |
| 4,420,204 A | * | 12/1983 | Leong | 439/599 |
| 4,575,174 A | * | 3/1986 | Leeds et al. | 439/465 |
| 4,653,836 A | * | 3/1987 | Peele | 439/610 |
| 4,842,546 A | | 6/1989 | Song | |
| 5,382,176 A | | 1/1995 | Norden | |
| 5,453,024 A | | 9/1995 | Patinier | |
| 5,774,980 A | * | 7/1998 | Klein et al. | 29/857 |
| 5,975,938 A | | 11/1999 | Libby | |
| 6,007,384 A | * | 12/1999 | Kraemer et al. | 439/610 |
| 6,033,256 A | * | 3/2000 | Odorfer | 439/465 |
| 6,071,141 A | * | 6/2000 | Semmeling et al. | 439/353 |
| D429,693 S | | 8/2000 | Hwang | |

* cited by examiner

*Primary Examiner*—Javaid H. Nasri
*Assistant Examiner*—Thanh-Tam Le

(57) ABSTRACT

A electrical connector for coupling to an electrical cable of the type having individual sheathed conductors without having to remove the sheathing. The electrical connector includes a base housing member that is couplable to a power source. Coupling assemblies mounted in the base housing member make electrical contact with a conductive member within sheathed conductors of an electrical cable. Each of the coupling assemblies comprises a top member and a bottom member which are pivotally coupled at one end. A set of piercing members mounted in the bottom member in a staggered pattern protrude through the sheathing and contact the conductive member when the top member is depressed down. The top member has bores which receiver the piercing members to ensure a good electrical contact. A strain relief assembly restricts outward movement of the electrical cable from the base housing member. A cover housing member is removably mountable on the base housing member for selectively enclosing the interior. A locking member selectively couples the housing members together.

20 Claims, 6 Drawing Sheets

ELECTRICAL CONNECTOR

BACKGROUND OF THE INVENTION

1. Field of the Invention

The present invention relates to electrical connectors and more particularly pertains to a new electrical connector for coupling to an electrical cable of the type having individual sheathed conductors without having to remove the sheathing.

2. Description of the Prior Art

The use of electrical connectors is known in the prior art. U.S. Pat. No. 5,975,938 describes a quick connect electrical connector for multi-conductor insulated cable wiring. Another type of electrical connector is U.S. Pat. No. 5,453,024 which is a two-pin electrical plug to be wired without unsheathing the lead.

While these devices fulfill their respective, particular objectives and requirements, the need remains for a device that assures good electrical contact even after a long period of use.

SUMMARY OF THE INVENTION

The present invention meets the needs presented above by incorporating separate connecting assemblies for each conductor. Each assembly utilizes a staggered pin in hole technique to make contact with the conductive member inside the sheathing in multiple places. A rear portion of each assembly also serves to engage the sheathed conductor to better hold it in place, along with a unique strain relief incorporated into the housing.

An object of the present invention is to provide a new electrical connector that allows the user to work on one of the connections without worrying about another already coupled conductor coming loose due to the fact that it is being held by its respective assembly.

Another object of the present invention is to provide a new electrical connector that more quickly and easily allows the user to make the secure each of the connections and attach a cover member with a simple ninety degree turn of a cover locking mechanism.

To this end, the present invention generally comprises a base housing member that is couplable to a power source. Coupling assemblies mounted in the base housing member make electrical contact with a conductive member within sheathed conductors of an electrical cable. Each of the coupling assemblies comprises a top member and a bottom member which are pivotally coupled at one end. A set of piercing members mounted in the bottom member in a staggered pattern protrude through the sheathing and contact the conductive member when the top member is depressed down. The top member has bores which receiver the piercing members to ensure a good electrical contact. A strain relief assembly restricts outward movement of the electrical cable from the base housing member. A cover housing member is removably mountable on the base housing member for selectively enclosing the interior. A locking member selectively couples the housing members together.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

The objects of the invention, along with the various features of novelty which characterize the invention, are pointed out with particularity in the claims annexed to and forming a part of this disclosure.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
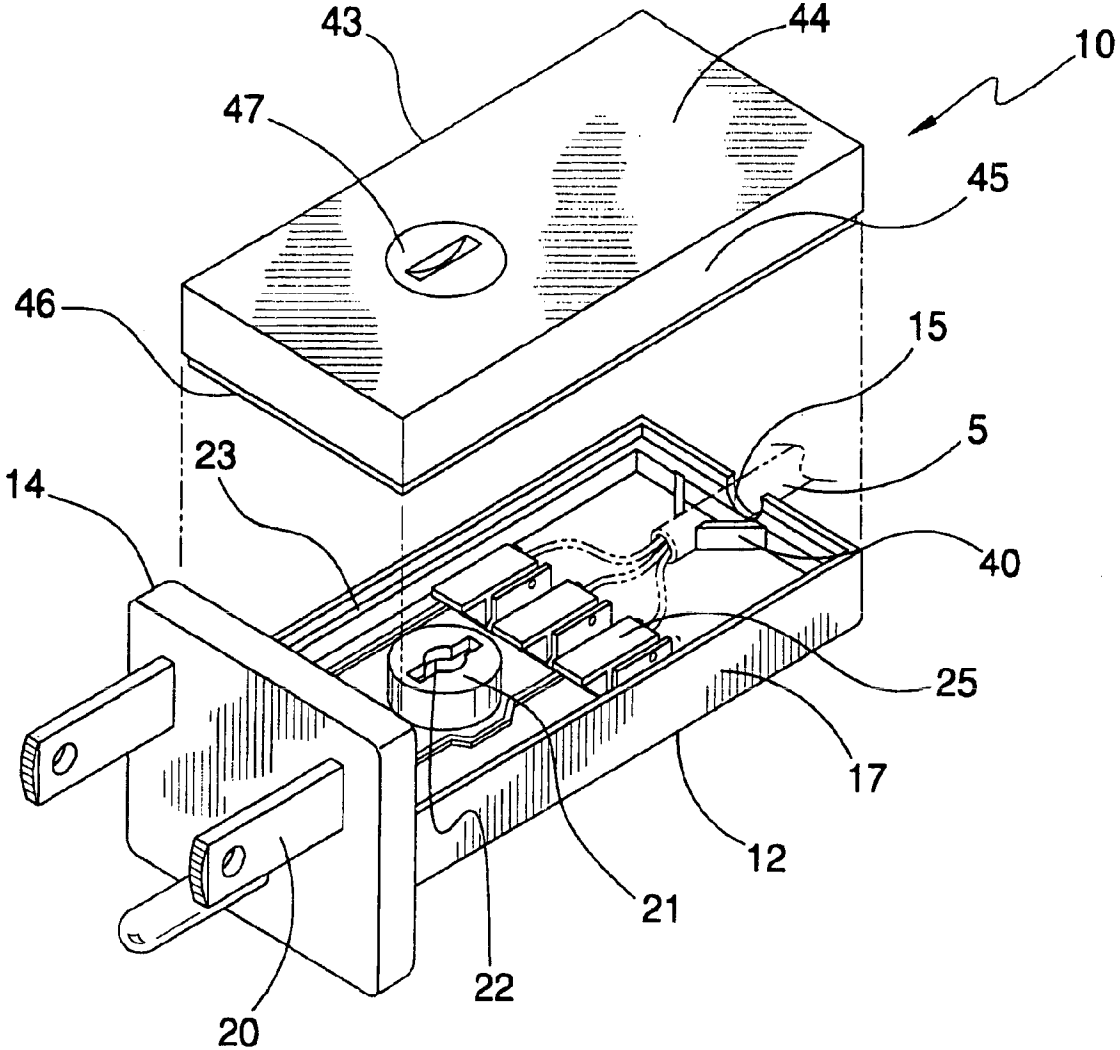
FIG. 1 is a schematic perspective view of a new electrical connector according to the present invention.
Figure 2:
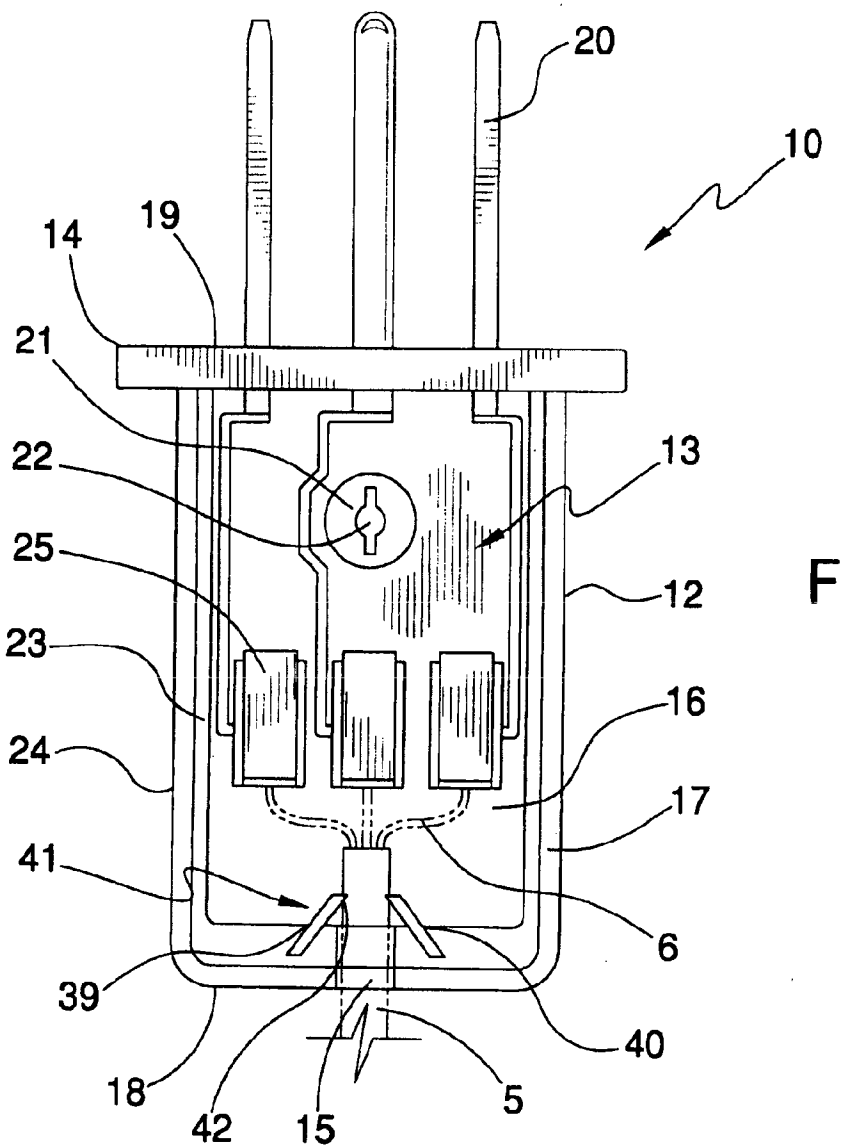
FIG. 2 is a schematic top view of the present invention.
Figure 3:
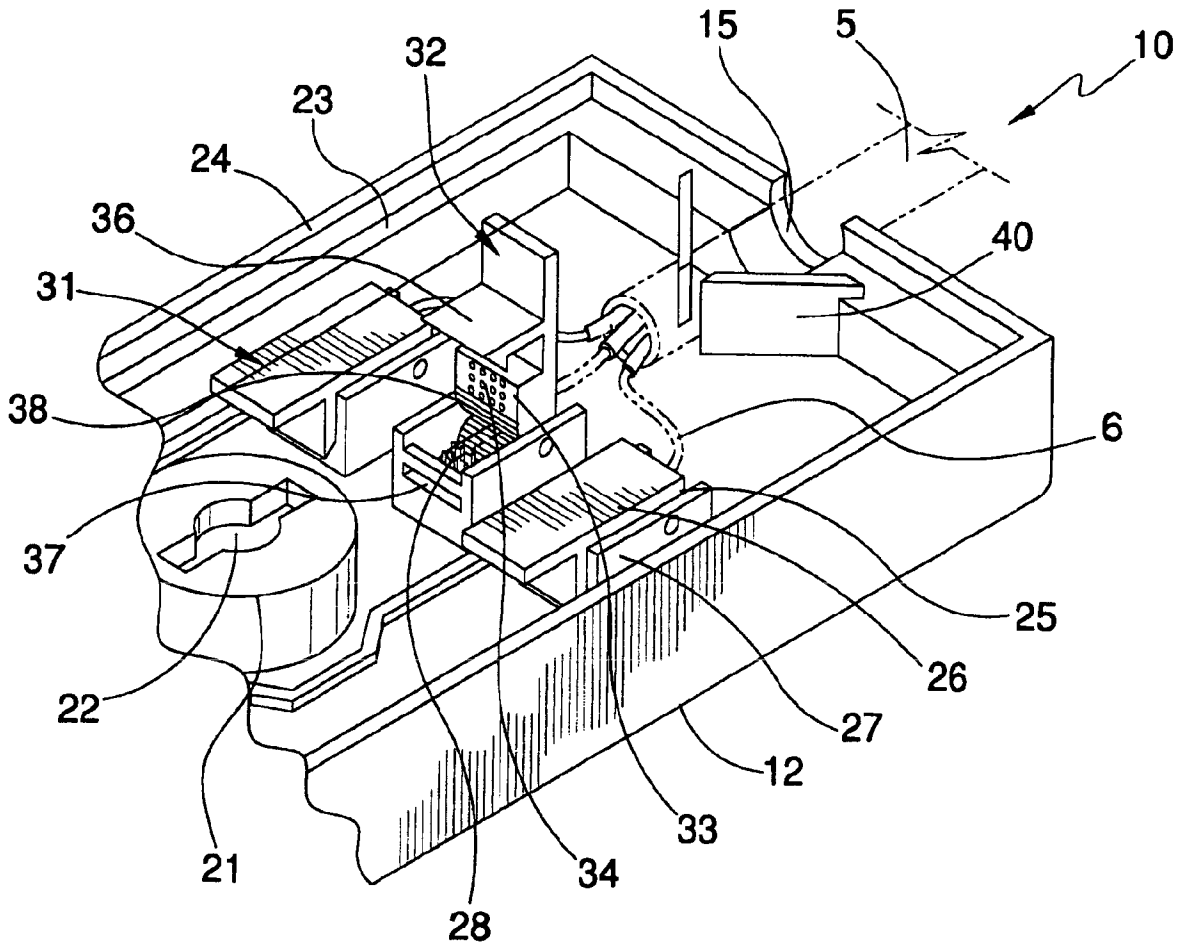
FIG. 3 is a schematic perspective view of the connector portion of the present invention.
Figure 4:
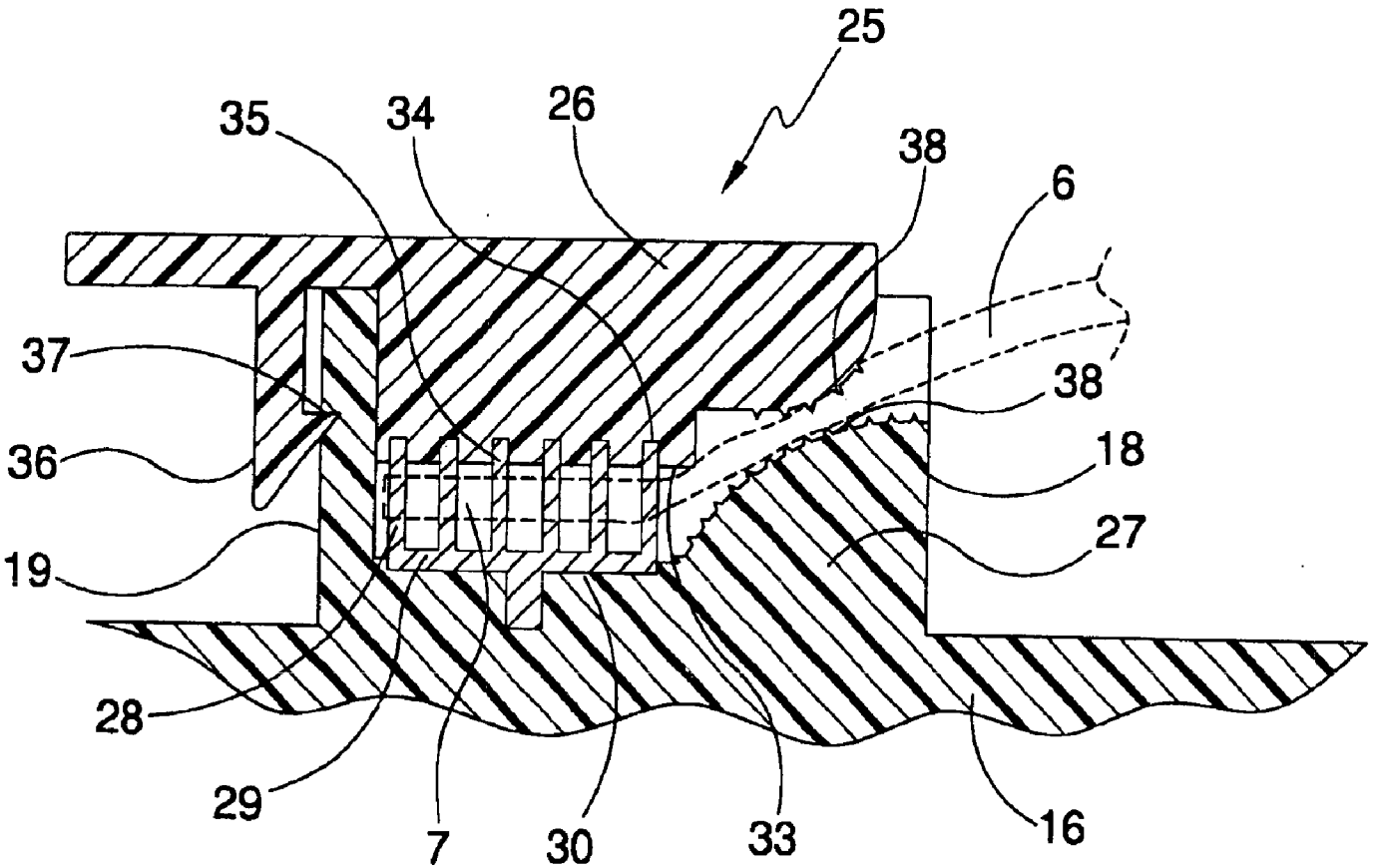
FIG. 4 is a schematic cross-sectional side view of a connector of the present invention.
Figure 5:
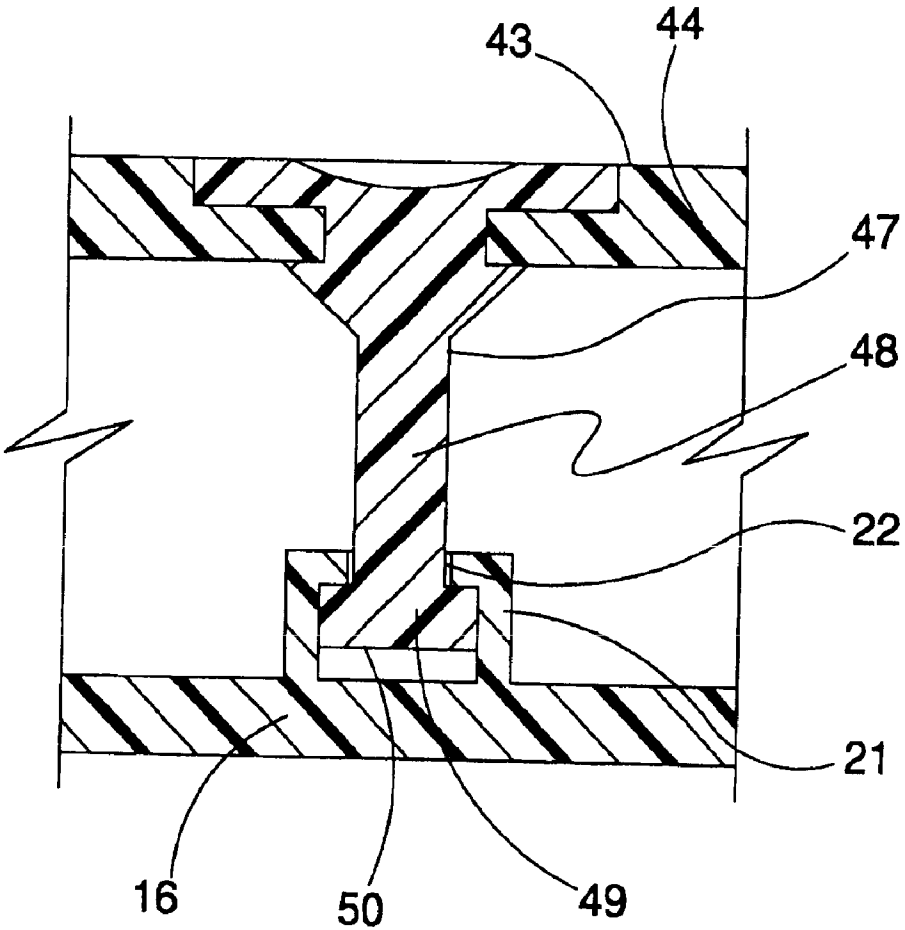
FIG. 5 is a schematic cross-sectional view of the locking member of the present invention.
Figure 6:
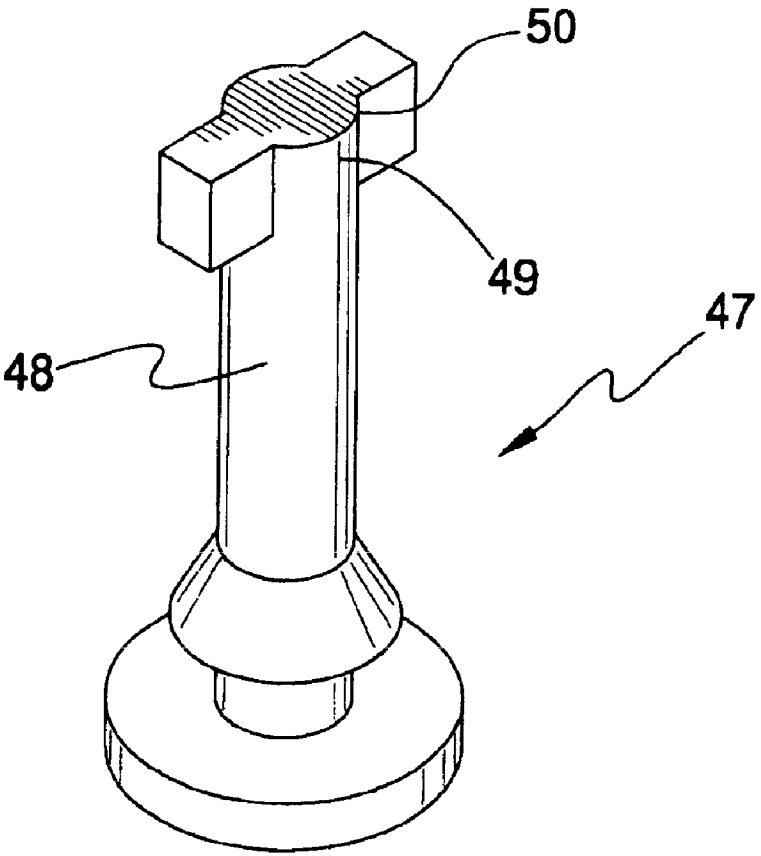
FIG. 6 is a schematic perspective view of the locking member of the present invention.

With reference now to the drawings, and in particular to FIGS. 1 through 6 thereof, a new electrical connector embodying the principles and concepts of the present invention and generally designated by the reference numeral 10 will be described.

As best illustrated in FIGS. 1 through 6, the electrical connector 10 generally comprises a base housing member 12 that has an interior 13. The base housing member 12 has a connector portion 14 for selectively coupling to a power source, and an arcuate cutout 15 for receiving an electrical cable 5. The base housing member 12 has a bottom wall 16 and a peripheral wall 17 attached to and extending away from the bottom wall 16 to define the interior 13. The base housing member 12 has a first end 18 and a second end 19.

The connector portion 14 includes a plurality of male connecting members 20 for being inserted into an electrical outlet, and is positioned adjacent to the second end 19 of the base housing member 12.

The cutout 15 is positioned in the peripheral wall 17 and located adjacent to the first end 18 of the base housing member 12.

The base housing member 12 includes a locking portion 21 mounted on the bottom wall 16 and is positioned in the interior 13. The locking portion 21 has a keyed hole 22 extending therethrough.

The base housing member 12 has a ledge portion 23 located along an interior 13 perimeter of the peripheral wall 17 and is positioned generally below an upper edge 24 of the peripheral wall 17.

A plurality of coupling assemblies 25 makes electrical contact with a conductive member 7 within sheathed conductors 6 of the electrical cable 5. Each of the coupling assemblies 25 comprises a top member 26 and a bottom member 27 and has a first end 18 and a second end 19.

The bottom member 27 includes a plurality of elongate conductive piercing members 28 for contacting the conductive member 7 within the sheathed conductor. Each of the piercing members 28 is mounted on a conductive base plate 29 and is oriented substantially perpendicular to the base plate 29. Each of the piercing members 28 is in electrical communication with the base plate 29. Each of the piercing members 28 is spatially oriented on each of the base plate 29*s* in a staggered pattern for the facilitation of electrical contact with the conducting member within the sheathed conductors 6.

One each of the base plates 29 is electrically coupled to one each of the plurality of connecting members 20 of the base housing member 12. Each of the base plates 29 is mounted on a lower portion 30 of the bottom member 27 of each of the coupling assemblies 25.

The first end 18 of each the top and bottom members 26, 27 are hingably coupled such that each of the coupling assemblies 25 are movable between a latched position 31 and an unlatched position 32.

A bottom side 33 of each of the top members 26 has a plurality of bores 34 extending therein for receiving the piercing members 28 of each of the bottom members 27. Each of the bores 34 is spatially oriented such that each one of the bores 34 corresponds to an associated one of the piercing members 28 of each of the bottom members 27. Upper ends 35 of each of the piercing members 28 are insertable into each of the bores 34 of each of the top members 26 when the second end 19 of each of the top members 26 is fully rotated towards the second end 19 of each of the bottom members 27 and each of the second ends 19 abut.

The second end 19 of each of the top members 26 includes a latch member 36 for engaging a recess 37 in each of the second ends 19 of the bottom members 27 such that each of the second ends 19 are releasably attachable to each other.

An arcuate portion 38 of the first end 18 of each of the top and bottom members 26, 27 are serrated across a width of each of the top and bottom members 26, 27 for selectively engaging the sheathed conductors 6 when in the latched position 31.

The latched position 31 of each of the coupling assemblies 25 is characterized by the top member 26 being rotated towards the bottom member 27 such that the second ends 19 of the top and bottom members 26, 27 abut and the latching member engages the recess 37. The unlatched position 32 of each of the coupling members is characterized by the second end 19 of the top member 26 being rotated away from the second end 19 of the bottom member 27.

Each of the coupling assemblies 25 is mounted in the interior 13 of the base housing member 12.

A strain relief assembly 39 restricts outward movement of the electrical cable 5 from the base housing member 12. The strain relief assembly 39 is mounted on the first end 18 of the base housing member 12.

The strain relief assembly 39 comprises a pair of resiliently flexible plate members 40 each positioned on opposite sides of the cutout 15 of the base housing member 12. Each of the plate members 40 extends into the interior 13 and towards the second end 19 of the base housing member 12. Each of the plate members 40 are oriented substantially perpendicular to the bottom wall 16 of the base housing member 12. Each of the plate members 40 are angled inwardly towards each other such that free ends 41 of each of the plate members 40 are biased away from each other by the electrical cable 5 allowing the electrical cable 5 to pass between each of the plate members 40 into the interior 13 of the base housing member 12. The free ends 41 of the plate members 40 engage an exterior 42 of the electrical cable 5 such that outward movement of the electrical cable 5 biases the free ends 41 towards each other thereby restricting removal of the electrical cable 5 from the base housing member 12.

A cover housing member 43 is removably mountable on the base housing member 12 for selectively enclosing the interior 13 of the base housing member 12. The cover housing member 43 has a top wall 44 and an outer wall 45 attached to and extending away from the top wall 44.

The cover housing member 43 has a lip portion 46 positioned about a perimeter edge of the outer wall 45 for engaging the ledge portion 23 of the base housing member 12.

A locking member 47 selectively couples the cover housing member 43 to the base housing member 12. The locking member 47 is rotatably coupled to the top wall 44 of the cover housing member 43. A shaft portion 48 of the locking member 47 extends away from the top wall 44 in the same direction as the outer wall 45. A bottom portion 49 of the locking member 47 comprises a keyed shaft 50 for inserting into the keyed hole 22 of the locking portion 21 of the base housing member 12. The cover housing member 43 is couplable to the base housing member 12 when the locking member 47 is rotated ninety degrees with relation to the locking portion 21.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. An electrical connector for coupling to an electrical cable of the type having individual sheathed conductors, said electrical connector comprising:

a base housing member having an interior, said base housing member having a connector portion for selectively coupling to a power source, said base housing member having an arcuate cutout for receiving the electrical cable;

a plurality of coupling assemblies for making electrical contact with a conductive member within the sheathed conductors of the electrical cable, each of said coupling assemblies comprising a top member and a bottom member, each of said coupling assemblies having a first end and a second and, each of said coupling assemblies being mounted in said interior of said base housing member;

a strain relief assembly for restricting outward movement of the electrical cable from said base housing member, said strain relief assembly being mounted on a first end of said base housing member;

a cover housing member being removably mountable on said base housing member for selectively enclosing said interior of said base housing member;

a locking member for selectively coupling said cover housing member to said base housing member; and said bottom member including a plurality of elongate conductive piercing members for contacting the conductive member within the sheathed conductor.

2. The electrical connector as set forth in claim 1, further comprising said base housing member having a bottom wall and a peripheral wall attached to and extending away from said bottom wall to define said interior, said base housing member having said first end and a second end.

3. The electrical connector as set forth in claim 2, further comprising said connector portion including a plurality of male connecting members for inserting into an electrical outlet, said connector portion being positioned adjacent to said second end of said base housing member, said cutout extending through said peripheral wall such that said cutout is positioned in said first end of said base housing member.

4. The electrical connector as set forth in claim 2, further comprising said base housing member including a locking portion, said locking portion being mounted on said bottom wall and being positioned in said interior, said locking portion having a keyed hole extending therethrough.

5. The electrical connector as set forth in claim 2, further comprising said base housing member having a ledge portion located along an interior perimeter of said peripheral wall and being positioned generally below an upper edge of said peripheral wall.

6. The electrical connector as set forth in claim 1, further comprising each of said piercing members being mounted on a conductive base plate, each of said piercing members being oriented substantially perpendicular to said base plate, each of said piercing members being in electrical communication with said base plate.

7. The electrical connector as set forth in claim 6, further comprising each of said piercing members being spatially oriented on each of said base plates in a staggered pattern for the facilitation of electrical contact with the conductive member within the sheathed conductors.

8. The electrical connector as set forth in claim 6, further comprising each of said base plates being electrically coupled to said connector portion of said base housing member, each of said base plates being mounted on a lower portion of said bottom member of each of said coupling assemblies.

9. The electrical connector as set forth in claim 1, further comprising said first end of each of said top and bottom members being hingably coupled such that each of said coupling assemblies are movable between a latched position and an unlatched position.

10. The electrical connector as set forth in claim 1, further comprising a bottom side of each of said top members having a plurality of bores extending therein for receiving said piercing members of each of said bottom members, each of said bores being spatially oriented such that each one of said bores corresponds to an associated one of said piercing members of each of said bottom members, upper ends of each of said piercing members protruding into each of said bores of each of said top members when said top member is position atop said bottom member.

11. The electrical connector as set forth in claim 1, further comprising said second end of each of said top members including a latching member for engaging a recess in each of said second ends of said bottom members such that each of said second ends are releasably attachable to each other.

12. The electrical connector as set forth in claim 9, further comprising an arcuate portion of said first end of each of said top and bottom members being serrated across a width of each of said top and bottom members for selectively engaging the sheathed conductors when in said latched position.

13. The electrical connector as set forth in claim 11, wherein a latched position of each of said coupling assemblies is characterized by said top member of said coupling assembly being rotated towards said bottom member such that said second ends of said top and bottom members abut and said latching member engages said recess, and an unlatched position of each of said coupling members is characterized by said second end of said top member being rotated away from said second end of said bottom member.

14. The electrical connector as set forth in claim 2, further comprising said strain relief assembly comprising a pair of resiliently flexible plate members each positioned on opposite sides of said cutout of said base housing member, each of said plate members extending into said interior and towards said second end of said base housing member, each of said plate members being oriented substantially perpendicular to said bottom wall of said base housing member.

15. The electrical connector as set forth in claim 14, further comprising each of said plate members being angled inwardly towards each other such that free ends of each of said plate members are biased away from each other by the electrical cable upon insertion allowing the electrical cable to pass between each of said plate members into said interior of said base housing member, said free ends engaging an exterior of the cable such that outward movement of the cable biases said free ends towards each other thereby restricting removal of the cable from the base housing member.

16. The electrical connector as set forth in claim 5, further comprising said cover housing member having a top wall and an outer wall attached to and extending away from said top wall, said cover housing member having a lip portion positioned about a perimeter edge of said outer wall for engaging said ledge portion of said base housing member.

17. The electrical connector as set forth in claim 16, further comprising said locking member being rotatably coupled to said top wall of said cover housing member, a shaft portion of said locking member extending away from said top wall in the same direction as said outer wall.

18. The electrical connector as set forth in claim 4, further comprising a bottom portion of said locking member comprising a keyed shaft for inserting into said keyed hole of said locking portion of said base housing member, wherein said cover housing member is couplable to said base housing member when said locking member is rotated ninety degrees with relation to said locking portion.

19. An electrical connector for coupling to an electrical cable of the type having individual sheathed conductors, said electrical connector comprising:

a base housing member having an interior, said base housing member having a connector portion for selectively coupling to a power source, said base housing member having an arcuate cutout for receiving the electrical cable;

a plurality of coupling assemblies for making electrical contact with a conductive member within the sheathed conductors of the electrical cable, each of said coupling assemblies comprising a top member and a bottom member, each of said coupling assemblies having a first end and a second end, each of said coupling assemblies being mounted in said interior of said base housing member;

a strain relief assembly for restricting outward movement of the electrical cable from said base housing member, said strain relief assembly being mounted on said second end of said base housing member;

a cover housing member being removably mountable on said base housing member for selectively enclosing said interior of said base housing member;

a locking member for selectively coupling said cover housing member to said base housing member; and said first end of each of said top and bottom members being hingably coupled such that each of said coupling assemblies are movable between a latched position and an unlatched position.

20. An electrical connector for coupling to an electrical cable of the type having individual sheathed conductors, said electrical connector comprising:

a base housing member having an interior, said base housing member having a connector portion for selectively coupling to a power source, said base housing member having an arcuate cutout for receiving the electrical cable;

a plurality of coupling assemblies for making electrical contact with a conductive member within the sheathed conductors of the electrical cable, each of said coupling assemblies comprising a top member and a bottom member, each of said coupling assemblies having a first end and a second end, each of said coupling assemblies being mounted in said interior of said base housing member;

a strain relief assembly for restricting outward movement of the electrical cable from said base housing member, said strain relief assembly being mounted on said second end of said base housing member;

a cover housing member being removably mountable on said base housing member for selectively enclosing said interior of said base housing member;

a locking member for selectively coupling said cover housing member to said base housing member; and said second end of each of said top members including a latching member for engaging a recess in each of said second ends of said bottom members such that each of said second ends are releasably attachable to each other.

* * * * *